United States Patent [19]

Snow

[11] Patent Number: 4,556,936

[45] Date of Patent: Dec. 3, 1985

[54] ADJUSTABLE LIGHTING LUMINAIRE

[75] Inventor: Richard F. Snow, Vicksburg, Miss.

[73] Assignee: Cooper Industries, Inc., Houston, Tex.

[21] Appl. No.: 674,391

[22] Filed: Nov. 23, 1984

[51] Int. Cl.[4] ..... F21P 1/02

[52] U.S. Cl. ..... 362/371; 362/269

[58] Field of Search ..... 362/371, 269, 254

[56] References Cited

U.S. PATENT DOCUMENTS

| | | | |
|---|---|---|---|
| 242,930 | 6/1881 | Hussey | 362/371 |
| 581,465 | 4/1897 | Kirby | 362/371 |
| 1,501,411 | 7/1924 | Hyatt | 362/371 |
| 3,246,135 | 4/1966 | Husby | 362/269 |
| 4,164,784 | 8/1979 | Jaksich | 362/371 |
| 4,320,443 | 3/1982 | Zwillich | 362/371 |
| 4,323,953 | 4/1982 | Hutchison | 362/269 |
| 4,388,680 | 6/1983 | Moore | 362/371 |

*Primary Examiner*—Ronald B. Cox

*Attorney, Agent, or Firm*—Eddie E. Scott

[57] ABSTRACT

A durable and adjustable lighting luminaire is provided that will allow the orientation of the projected light to be adjusted. The luminaire housing forms a saddle with a first leg and a second leg. A lamp socket is located in said first leg. A reflector-lens combination is rotatably positioned between the first and second legs and rotatably mounted over the lamp socket. The lamp and lamp socket extend into the reflector-lens combination. The ballast housing, ballast cover, reflector and lens are all constructed of polymeric material and connected together by snap or pressure fits and ultrasonic welding. The resulting luminaire is corrosion, impact, weather and vandal resistant.

4 Claims, 4 Drawing Figures

Fig. 1
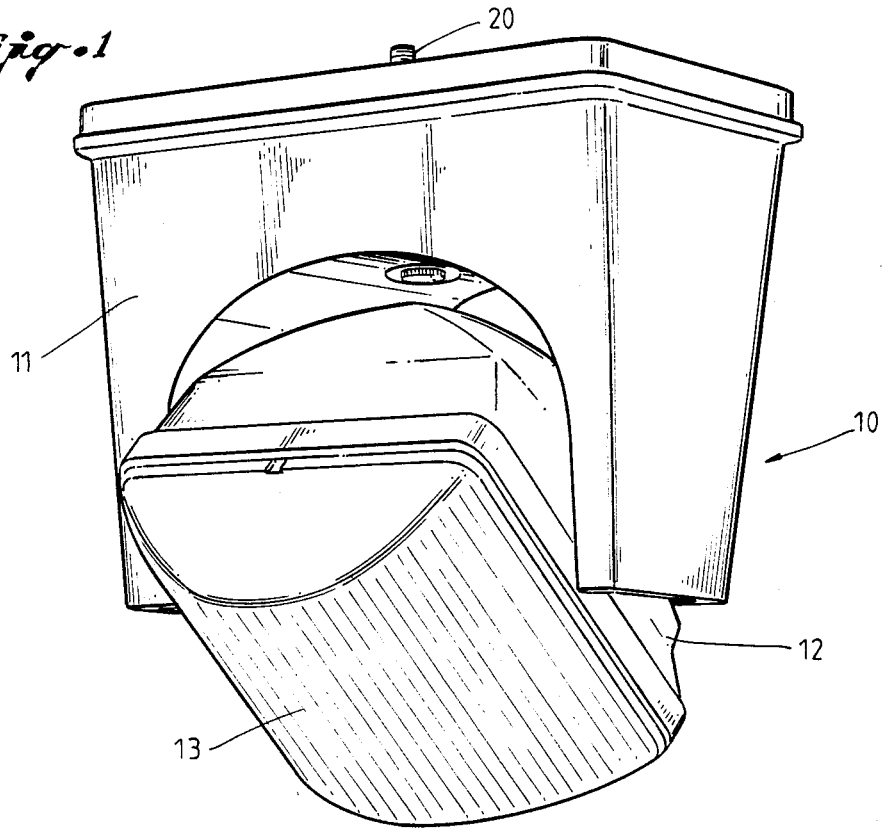
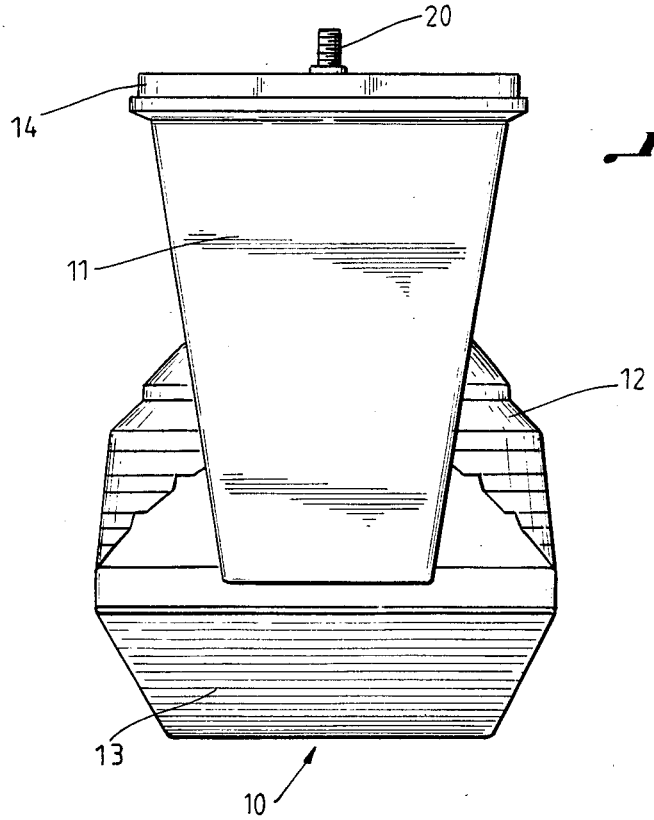
Fig. 2

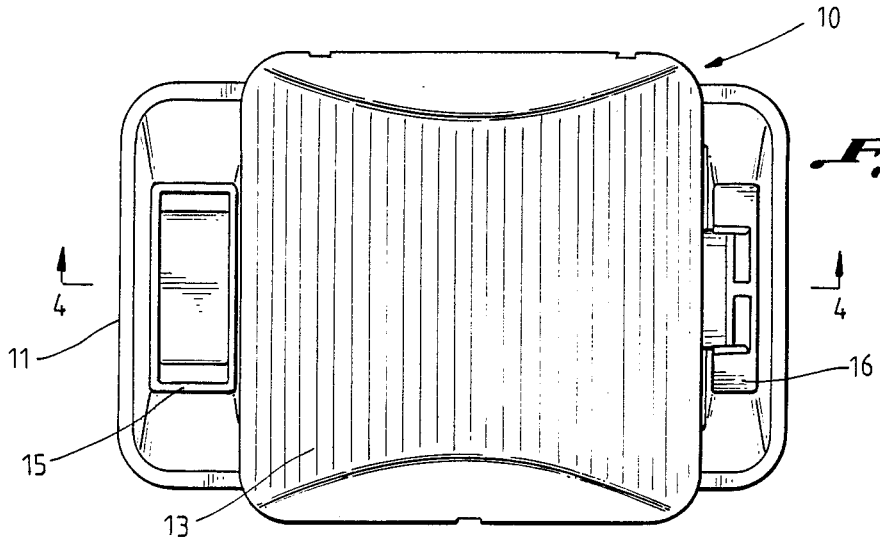
Fig. 3
Fig. 4
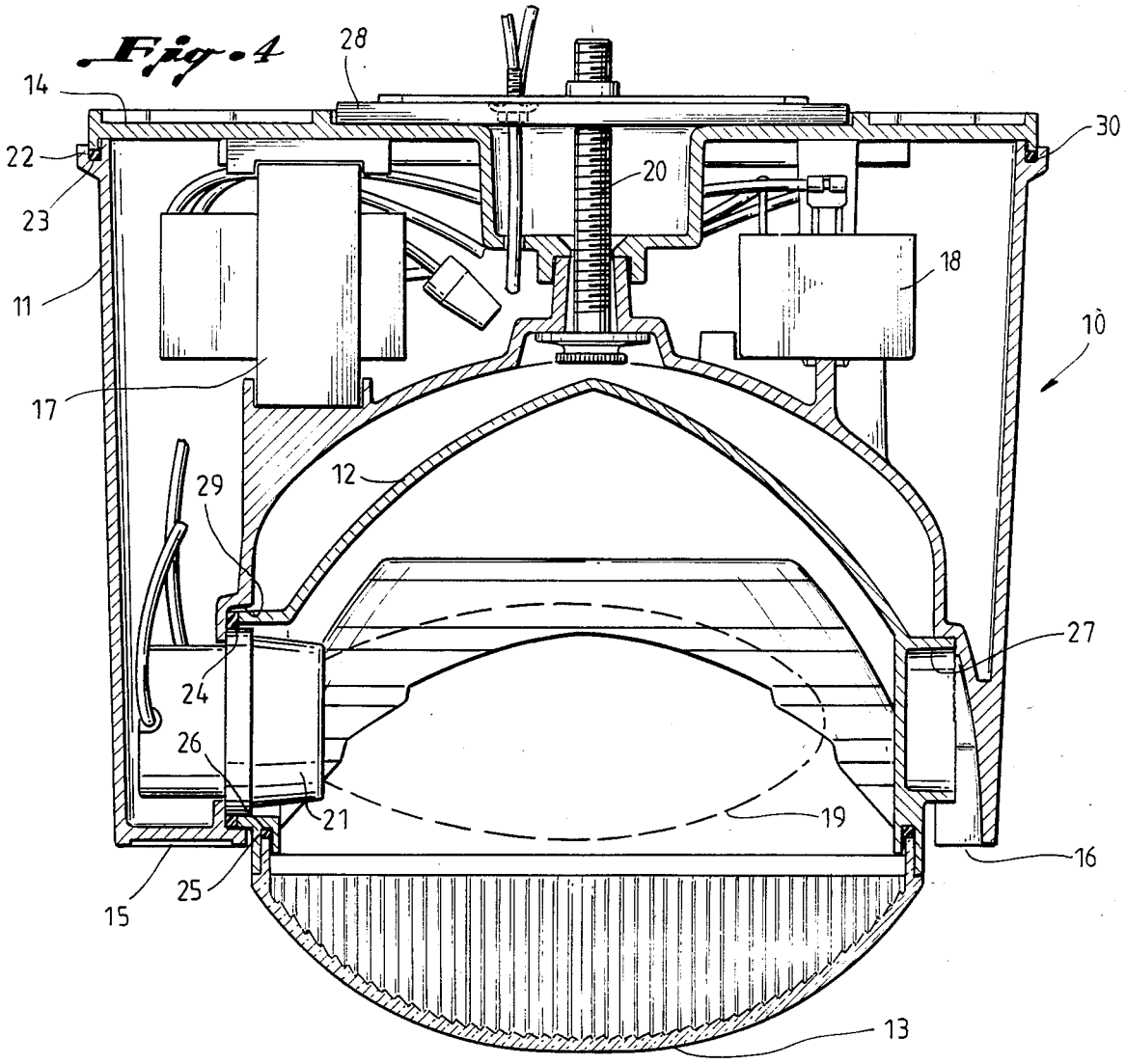

ADJUSTABLE LIGHTING LUMINAIRE

BACKGROUND OF THE INVENTION

1. Field of the Invention

The present invention relates in general to the field of area lighting luminaires and in particular, to a durable and adjustable luminaire which allows the distribution of light emanating therefrom onto different locations of the ground for lighting walkways, stairways and various other areas.

2. Background Art

An area lighting luminaire is shown in U.S. Pat. No. 3,697,740 invented by Charles P. Breed and Melvin R. Anderson, patented Oct. 10, 1972, The luminaire includes a base having a lamp socket and lamp mounted thereon and extending above the base. The lamp and lamp socket are surrounded by a light distributing housing which includes a cylindrical fresnel lens surrounded by a plurality of stacked annular louvers spaced one from the other and extending radially and downwardly to shield the lens and lamp from view at viewing angles of horizontal and above. A cover member closes off the top of the light distributing housing and may include a central lens portion for the vertical release of light.

In U.S. Pat. No. 4,383,316 invented by Hendrik A. J. de Vos and Elzear R. Labouliere, an outdoor luminaire with readily severable 2-part housing is shown. The luminaire is particularly suited for outdoor applications (e.g., for illuminating roadways and alleyways) and includes a 2-part housing. One of the parts (the base) is metallic and the other (refracting portion) is of lightweight (plastic) material and includes both an opaque chamber for housing the luminaire's rectangular aluminum reflector and a refracting, prismatic lens. The reflector is slidably positioned in the chamber portion and thus readily removable when both parts of the housing are separated. The luminaire is capable of providing either an IES type II or III distribution on the ground therebelow when oriented vertically.

In U.S. Pat. No. D 226,020 invented by Melvin R. Anderson and Donald P. Husby patented Jan. 16, 1973, a flood light is shown. This patent discloses an ornamental design for a flood light. Lighting luminaire are also shown in U.S. Pat. No. 4,028,541 and 4,225,906.

SUMMARY OF THE INVENTION

The present invention provides a durable luminaire which allows adjustable aiming of the light beam and which is constructed in such a way that it is corrosion, impact, whether and vandal resistant. The luminaire housing forms a saddle with a first leg and a second leg. A lamp socket is located in said first leg. A reflector-lens means for directing light is rotatably positioned between said first and second legs. The lamp socket and lamp are located within the reflector-lens means. The reflector-lens means can be turned about the lamp axis thereby adjusting the direction of the beam of light without disturbing the lamp or wiring. The foregoing and other features and advantages of the present invention will become apparent from a consideration of the following detailed description of the invention when taken in conjunction with the accompanying drawings.

BRIEF DESCRIPTION OF THE DRAWINGS

The attendant advantage of this invention will become more readily apparent and better understood as the following detailed description of an exemplary embodiment of the invention is considered in connection with the accompanying drawings, in which:

FIG. 1 is a pictorial representation illustrating the external appearance of a luminaire constructed in accordance with this invention.

FIG. 2 is a side view of the luminaire illustrated in FIG. 1.

FIG. 3 is an end view of the luminaire shown in FIG. 2.

FIG. 4 is a sectional view taken along the line 4—4 of FIG. 3.

DESCRIPTION OF THE PREFERRED EMBODIMENT

Referring now in detail to the drawings wherein like reference characters represent like parts throughout the several views, there is illustrated pictorially in FIG. 1 an area lighting luminaire constructing in accordance with this invention and generally designated by the reference number 10. The luminaire 10 includes a lens 13 and reflector 12 combination rotatably mounted in a saddle formed by the housing 11. The lens 13 can be turned 90° in the reflector 12 to direct the light in different directions.

Referring now to FIG. 2, a side view of the luminaire 10 is shown. The housing 11 supports the lens 13 reflector 12 combination which can be turned in the saddle formed by the housing to direct light onto the desired surface. The luminaire 10 can be mounted on a wall, ceiling or other location utilizing the bolt 20.

Referring now to FIG. 3, the luminaire 10 previously shown in FIGS. 1 and 2 is illustrated by an end view. A first leg 15 and second leg 16 of the housing 11 forms a saddle for receiving the lens reflector combination. The lens reflector combination is inserted into the saddle formed by the housing 11 and becomes secured in place between the first leg 15 and the second leg 16 without requiring additional hardware.

Referring now to FIG. 4, a sectional view of the luminaire 10 is shown representing a view taken along lines 4—4 of FIG. 3. The luminaire 10 has six major parts. These six major parts include the ballast housing 11, ballast cover 14, reflector 12, lens 13, lamp socket 21 and ballast-starter combination 17 and 18. The ballast housing 11, ballast cover 14, reflector 12 and lens 13 are all constructed of polymeric material in one form or another. All of these parts are connected together using snap or pressure fits and/or ultrasonic welding thereby eliminating the need for mechanical fasteners. The polymeric material is durable and the connections between parts together with certain gaskets makes the luminaire 10 corrosion, impact, weather and vandal resistant.

The reflector 12 lens 13 combination is mounted between the first leg 15 and the second leg 16 and is maintained in place by a snap fit. The reflector 12 has cored areas to allow for a slip fit around the lamp socket 21 and a snap fit into the ballast housing 11. Reflector-socket mounting recess 29 is located in the first leg 15. A reflector sealing gasket 24 is located within the reflector/socket mounting recess 29 to prevent entry of water into lamp receptable compartment. The lamp socket 21 is snapped into the reflector/socket mounting recess 29. The lens 13 is mounted to the reflector 12. A groove 25 is located in the open face of the reflector 12. A gasket 26 is located within the groove 25. The lens 13 is positioned on the groove 25 and locked in place by snap tabs. The gasket 26 provides a seal between the reflector 12 and lens 13 to prevent entry of water into the reflector compartment.

The ballast 17 and starter assembly 18 are located within the housing 11. A groove 22 is located in the housing 11. A gasket 23 is positioned within the groove 22. The cover 14 includes a lip 30 that fits over the groove 23. The cover 14 is connected to the housing 11 by ultrasonic welding. The gasket 23 provides a seal. A gasket 28 is placed between the housing 11 and mounting surface to prevent water entry into the house electrical system. The bolt 20 is used to attach the luminaire 10 to a desired location.

Grooves in housing 11 and cover 14 retain starter 18 and ballast 17 in position before and after cover is ultrasonically welded to housing.

The structural details of a luminaire 10 constructed in accordance with the present invention having been described. The assembly of the component parts of the luminaire 10 will now be described. The lamp socket 21 is snapped into place in the first leg 15 of the housing 11. The ballast 17 and starter assembly 18 are properly located in their specific areas. The gasket 23 is placed in its groove 22 and all internal wiring completed. The ballast housing cover 14 is then placed in position and ultrasonically welded in place.

To install the reflector 12, the lamp holder gasket 24 is placed around the lamp socket 21 in the reflector/-socket mounting recess 29 and the reflector 12 positioned over the lamp holder gasket 24. The reflector 12 is then snapped into place by applying pressure to the reflector 12 at a position opposite the lamp socket 21 area and near the second leg 16. The reflector pivot hub 27 is radially deformed as it is pressed into the rigid keyhole recess in the second leg 16 and recovers as it passes into its resting place. The ballast housing 11 subassembly becomes completely sealed once the reflector 12 is snapped into place.

The lamp is installed in the lamp socket 21. Reflector 12 is adjustable about the center line of the lamp 19 axis. The lens 13 is installed by placing the gasket 26 in the gasket groove 25 of the reflector 12 and properly positioning the lens over the gasket 26. Pressure is then applied to the lens 13 until the molded tabs on the lens 13 snap into the mating cored holes of the reflector 12. Once the lens 13 is snapped into place, the reflector 12 is completely sealed.

The embodiments of an invention in which an exclusive property or privilege is claimed are defined as follows:

1. An area lighting luminaire comprising:

a housing including an integral molded member having spaced apart first and second hollow leg portions and forming a comparment, a removable cover member for closing said compartment, a reflector-lens combination adapted to be supported between said leg portions, said reflector-lens combination including opposed hub portions journalled in means forming opposed recesses formed in said leg portions, respectively, and in such a way that said reflector-lens combination may be rotatably positioned with respect to said housing in a selected working position, one of said recesses being configured to have an open side such that said reflector-lens combination can be mounted on said housing by placing one of said hub portions in the other of said recesses and then radially deforming the other of said hub portions into said one recess, and a lamp socket located at least partially in one of said leg portions and projecting through said one hub portion for holding a lamp within the interior of said reflector-lens combination and to permit rotation of said reflector-lens combination about said hub portions, respectively.

2. The luminaire set forth in claim 1, including:

a resilient gasket disposed between means forming said other recess and said one hub portion and around said lamp socket for preventing entry of water into said compartment.

3. An area lighting luminaire comprising:

a housing including a member having spaced apart first and second hollow leg portions and forming a component, a removable cover member for closing said compartment, a lamp reflector adapted to be supported between said leg portions, said reflector including opposed generally cylindrical hub portions journalled in means forming opposed recesses in said leg portions, respectively, and in such a way that said reflector may be rotatably positioned with respect to said housing in a selected working position, one of said recesses being configured such that said reflector can be mounted on said housing by placing one of said hub portions in the other of said recesses and then radially deforming the other of said hub portions into said one recess, and a lamp socket located at least partially in one of said leg portions and projecting through said one hub portion for holding a lamp within the interior of said reflector and to permit rotation of said reflector about said hub portions, respectively.

4. An area lighting luminaire comprising:

a housing including a member having spaced apart first and second leg portions and forming a compartment, a cover member for closing said compartment, a lamp reflector adapted to be supported between said leg portions, said reflector including opposed integral hub portions journalled in means forming opposed recesses in said leg portions, respectively, and in such a way that said reflector may be rotatably positioned with respect to said housing in a selected working position, said recesses being configured such that said reflector can be mounted on said housing by placing one of said hub portions in one of said recesses and then forcably deforming the other of said hub portions into the other of said recesses, and a lamp socket located at least partially in one of said leg portions and projecting through one of said hub portions for holding a lamp within said reflector and to permit rotation of said reflector relative to said housing about said hub portions, respectively.

* * * * *